United States Patent [19]

Dixon et al.

[11] 3,988,491

[45] Oct. 26, 1976

[54] FLUORINATION OF POLYESTERS AND POLYAMIDE FIBERS

[75] Inventors: Dale D. Dixon, Kutztown; Larry J. Hayes, Trexlertown, both of Pa.

[73] Assignee: Air Products and Chemicals, Inc., Allentown, Pa.

[22] Filed: Jan. 17, 1974

[21] Appl. No.: 434,285

[52] U.S. Cl. ..... 428/288; 260/75 H; 260/75 T; 427/248 R; 427/400; 427/444; 428/395

[51] Int. Cl.[2] ..... D04H 1/58

[58] Field of Search ..... 117/138.8 F, 47 A, 118, 117/138.8 N; 8/115.5, DIG. 4, 168.2; 260/75 H, 75 T; 427/400, 248, 444; 428/288, 395

[56] References Cited

UNITED STATES PATENTS

| | | | |
|---|---|---|---|
| 2,129,289 | 9/1938 | Söll | 117/118 |
| 2,811,468 | 10/1957 | Joffre | 117/47 |
| 2,829,070 | 4/1958 | Osborn | 260/75 |
| 3,255,099 | 6/1966 | Wolinski | 117/47 |
| 3,364,056 | 1/1968 | Seibel | 117/118 |
| 3,740,256 | 6/1973 | Manion et al. | 117/138.8 |

*Primary Examiner*—Ronald H. Smith
*Assistant Examiner*—Sadie L. Childs
*Attorney, Agent, or Firm*—Richard A. Dannells; Barry Moyerman

[57] ABSTRACT

The present invention relates to surface modification of synthetic resin fiberform materials, notably polyamide and polyester fiberform materials whose surface has been modified by treatment with elemental fluorine, and to the fluorination process.

14 Claims, No Drawings

FLUORINATION OF POLYESTERS AND POLYAMIDE FIBERS

This application is a continuation-in-part of application U.S. Ser. No. 185,412, filed Sept. 30, 1971 (now abandoned) and of U.S. Ser. No. 285,831, filed Sept. 1, 1972 (now abandoned).

BACKGROUND OF THE INVENTION

The advent of synthetic resin films and fibers with chemical make up substantially different from the long known natural products like wool and cellulose has required the art to intensively investigate various methods of surface treatment of films and fibers to improve heat sealing of films, printing on films, dyeing fabric and the like. The workers in the art had a natural tendency to equate film treatment with fiber treatment, to equate treatment of polyolefins, polyamides, polyesters, polyacrynitriles, etc., to equate chlorine with fluorine. In addition, the art has focused on a relatively limited number of properties, notably heat sealing, adhesion, dye or printing ink receptivity.

The now abandoned application U.S. Ser. No. 185,412 and the now abandoned application U.S. Ser. No. 285,831 of which the present application is a continuation-in-part, had principally directed attention to the improvement in dye receptivity. However, other surface characteristics are important, particularly when the material under consideration is in an already dyed fabric form. Good soil and stain release and water absorbtivity are highly desirable characteristics.

THE INVENTION

Briefly stated, the present invention involves subjecting fiber form synthetic resins selected from the group consisting of polyesters and polyamides to a fluorination treatment. Such treatment is effected in an atmosphere of low oxygen content, preferably one substantially free of oxygen, for relatively brief periods of exposure. A mild fluorination treatment is intended. In no event is the fiber form resin fluorinated to a combined fluorine content in excess of 5% and preferably far less than 1% by weight of the fiber. Although discussed hereafter entirely in terms of polyesters and polyamides, the fluorination treatment of the present invention is of general applicability to fiber form synthetic resins. For detailed disclosure to fluorinating fiber form polyolefins and polyacrylonitriles, reference is made to copending application Ser. No. 434,284, filed concurrently herewith and now abandoned.

As a result of the fluorination treatment the fiber form material will be fluorinated in the surface layers only. The fluorination level can be expressed as being from $4 \times^{-7}$ to $4 \times 10^{-1}$ mg F/cm$^2$. Inasmuch as intrusive fluorination causes a substantial decrease in the tensile strength of the fiber, one direct measure of the extent to which fluorination has taken place, is loss of tensile strength relative to the untreated fiber. The fiber form synthetic resins treated according to practice of the present invention, retain in excess of 80% of their tensile strength, preferably in excess of 90%, and most desirably in excess of 95%.

In accordance, then, with the present invention, polyester or polyamide materials are directly fluorinated in an atmosphere considered substantially free of oxygen. That is to say a mixture of carrier gas and fluorine gas, virtually free of any oxygen, is preferred, i.e., less than about 0.1% by volume. Substantially oxygen free, as used herein, is intended to denote both the fluorination gas mixture charge into whatever reactor is employed and the fluorination locus of the reactor when charged with said gas mixture. However, commercially available fluorine, as well as inert carrier gases, like nitrogen, may contain minor quantities of oxygen and the essentially unavoidable oxygen present in such gases, and that remaining in the reactor must be accepted as falling within the sense of a substantially free-of-oxygen fluorination.

As a practical matter, the fluorination may be successfully practiced with relatively small amounts of oxygen being present, up to about 5% by volume in the fluorination locus. Nevertheless, most optimally, it is preferred that the level of oxygen present be minimized to less than 0.1% by volume.

Thus, in carrying out the objectives of the present invention a fluorinating mixture substantially free of oxygen, comprising generally from about 0.1% to about 20% elemental fluorine and correspondingly from about 99.9% to about 80% of carrier gas may be used to fluorinate the fiber form polyamide or polyester resins. For most applications, the quantity of fluorine in the gaseous mixture feed to the fluorination will range from 0.1% to about 10%, the balance being carrier. A more preferable and economical range is from about 0.5% to about 10% fluorine. The fluorine content at the fluorination locus is always lower, sometimes as low as 0.1%.

During fluorination of polyesters and polyamides in accordance with the present invention, a fluorinated carboxylated layer is formed on the polymer surface. The formation of such a layer has been confirmed by means of an electron microscope, by infra-red spectoscopy and by direct titration tests made after the fluorinated product has been subjected to a standard wash cycle.

The combined fluorine groups and the carboxylate groups are concentrated at the fiber surface, i.e., within about 70A° of the fiber surface. What is not known for certain is the reaction mechanisms and the chemistry involved in the formation of carboxylate groups as incident to fluorination. The explanation of the fluorination reaction offered below is conjecture being posed without intent to bind the demonstrable advantageous results achieved by practice of this invention to as yet unproven theory.

In the instance of the polyester resin fibers from condensation of ethylene glycol with teraphthalic acid, the polyester formula is:

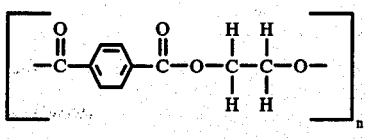

As may be seen from the formula each recurring monomeric unit contains 4 alkyl hydrogens and 4 ring hydrogens which may be replaced by fluorine. Studies based on the known reaction kinetics of comparable pure compounds, such as ethyl benzoate, diethyl terephthalate and ethylene glycol dibenzoate, indicate that certain fluorination reactions will be favored. Thus, the initial site of fluorine attack is believed to be at one of the alkyl hydrogens. It is believed also that the mildest fluorination, e.g. parts per million relative to the polyester substrate, will place a monofluoro substituent on one or both alkyl carbons without any ring fluorination. However, the high energy levels involved with fluorination reactions are believed to create free radicals, (transitory) double bond formation in the alkyl group, chain scission. The overall result is both fluorination and creation of carboxylate groups. Computations on monofilaments subjected to low levels of fluorine pickup, e.g. a post wash 0.01% F by weight indicate that the fluorine has become attached as a monofluoro substituent on the alkyl carbons with virtually no subsurface penetration by the fluorine, and no ring fluorination, and with formation of carboxylate groups, perhaps somewhat according to the simplified representation posed in the following formula:

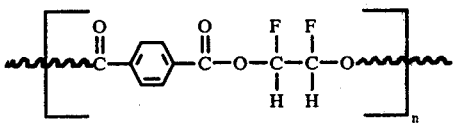

and/or

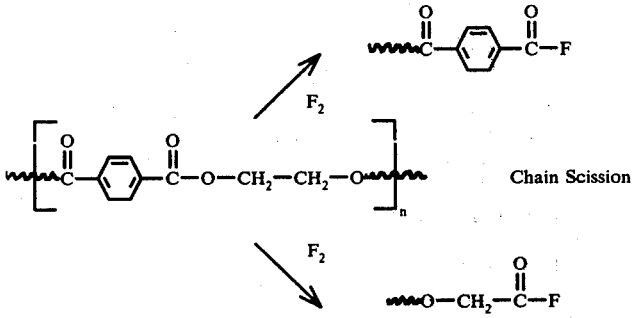

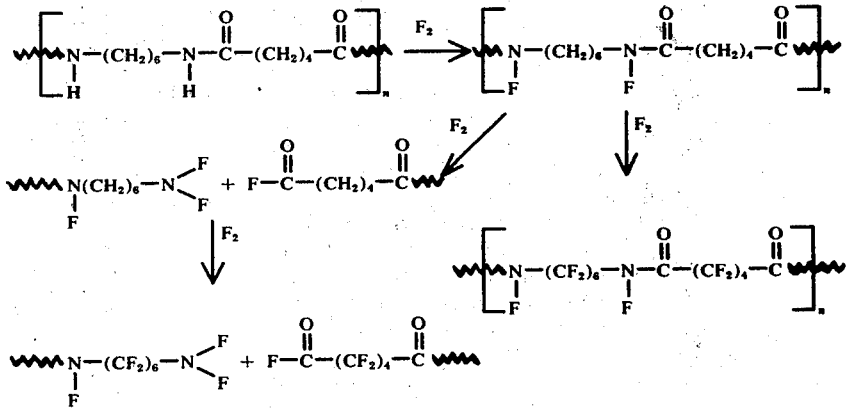

The fluorination reaction involves fluorination of the surface alkyl groups, subsurface fluorination, ring fluorination and chain scission. A self correcting situation seems to exist. The barrier against subsurface penetration of the fluorine and the apparently less favored ring fluorination direct the fluorine towards fresh fiber surface areas as yet unfluorinated. In consequence fiber or a woven or knit fabric (before or after dyeing), may be fluorinated surprisingly uniformly. Indeed, the thread or a fabric may be wound on a spool, and fluorinated. Fluorination will, of course, occur initially on the immediately exposed surfaces but subsequently the less exposed fiber surfaces such as exist in the interstices of the weave or knit and deep in the spool will fluorinate preferentially to fluorination subsurface of the more exposed surfaces, even it seems competively or preferentially to ring fluorination at the most exposed fiber surfaces.

The self correcting nature of the fluorination reactions is what makes practice of this invention applicable to all fiber forms of the polyesters and polyamides, including for example monofilaments, spun chopped fibers, weaves, non-woven fabrics, knits.

The self correcting character of fluorination makes a very low level of fluorination preferred for polyesters. Desirably the combined fluorine and the carboxylate groups are concentrated within about 10A of the fiber surface.

The polyamide fluorination reactions are believed to be different from those described above for polyesters even though in both resins the carbonyl groups constitute the source of the carboxylates ultimately produced. Since it is known that fluorine will cleave an amide bond to form COF and $F_2N$ a possible reaction path is:

The fluorination scission process probably takes place at random locations along the polymer chain. The extent of carboxyl formation is dependent on the reaction conditions and the resin system. Indications are that the number of acid groups increase as reaction time is increased at a given fluorine concentration or alternatively with increasing fluorine concentration. In addition, the fluorine seems to penetrate the fiber subsurface of nylons more readily than occurs with polyesters but nonetheless fluorine is still concentrated in the surface regions, penetrating not more than about 70A, and all fiberforms of nylon may be fluorinated.

In any event, chemical theory aside, the fluorinated polyester or polyamide resin fiber has exceedingly desirable properties, notably release of oil staining and good water adsorption or moisture transport. The moisture transport property, measured by a wicking test, is attributable to presence of the carboxylate groups. Improved moisture transport is achieved both in polyesters and polyamides. The improvement in oil stain release is most striking in polyesters.

Untreated fabrics formed from polyester resin fibers are permanently stained by hydrocarbon and triglyceride oils. Such stains lift off under ordinary washing conditions from the fluorinated fiber fabrics. Even when the oil stain has literally been forced into the fabric, washing of the fluorinated fabric appears to remove the oil stain completely. Should a pale stain reappear at the site of the original stain, a phenomenon apparently due to migration of oil from beneath the fiber surfaces, repeated washing removes this secondary stain. Since polyamides already exhibit good stain release properties, the improvement which occurs upon fluorination is nominal, as a practical matter, and the stain release improvement is limited to polyesters.

The carboxylate groups do not detract from the stain release qualities imparted by the fluorination of polyesters and may even enhance stain release properties. The carboxylate groups created by fluorination are believed to be most advantageous, being directly accountable for the higher water adsorbency of the fluorinated polyester and polyamide fiber.

Basically, the wicking test is a test to determine the moisture transport of the fiber and fabrics formed therewith. The synthetics, notably the polyamide and the polyesters, have long been condemned for their lack of water absortivity. They have been called clammy, hot, sticky, because all but the smallest amount of free moisture on the surface of such fabrics made from polyamides and polyesters remain there as free moisture. The fabric is unable to absorb or wick away the moisture. Moisture absorbency is one material property where cotton and rayon are superior to the polyamides and polyester fibers. The sharply enhanced wicking of the surface fluorinated polyester or polyamide fiber constitutes a measure of the higher water adsorbtivity so long desired for the polyamide and polyester resin fabrics.

Although carboxylate groups on the fiber surface are an ultimate reaction product, they may not be created until the fiber is washed. Some possibility exists that the carboxylate groups form as the acyl fluoride, and only later hydrolyze to the carboxylate. Certainly a substantial loss of combined fluoride occurs upon an initial washing, and thereafter little or no loss of fluoride occurs upon repeat washing. Laundering with its alkaline conditions will, in theory, at least, convert any free carboxylic acid surface groups to the sodium carboxylate form. In this connection, treated fabrics washed then specially acid rinsed exhibit the same wicking level as like fabrics water rinsed in deionized water or laundered under alkaline conditions.

Age and repeated laundering or dry cleaning do not seem to materially affect fluorine content and carboxylate groups content of the fibers. Fabrics fluorinated according to practice of this invention have been laundered repeatedly without losing their good wicking properties or in the instance of polyesters their stain release properties and their good anti-redeposition properties.

In any event, whatever the reaction mechanism, surface fluorination of polyester and polyamide resins do create surface carboxylate groups. In this respect, fluorination is quite different from chlorination, even chlorination effected in the presence of activation (e.g. by ultra violet light), since chlorination does not create surface carboxylate groups to any significant degree. Accordingly, a substitution of chlorination for the fluorination fails to produce surface treated fibers with good wicking properties.

Allusion has been made to some decrease in tensile strength incident to fluorination. The decrease is minor, desirably less than 5%, preferably less than 10% and in all events for practice of this invention less than 20%. The exact reason for the loss of strength upon fluorination is not known. The loss seems greater than can be attributed to the degree of fluorination and carboxylate formation. Conceivably the energy released by the reaction causes localized deorientation (of the stretch oriented polymer) of the fiber. Fluorination of polyesters to different levels seems to cause an increasing loss in fiber tensile strength. However, up to about 0.5 wt. % fluorine pickup (measured before wash) causes nominal loss in strength, with tests indicating tensile strength retention of 90% or better.

In the case of polyamides tensile strength has also been found to decrease upon extended fluorination. However, the tensile strength is more sensitive to process conditions than are the polyesters.

Tensile strength measurement is therefore a measurement of the fluorination reaction, quantitatively as well as qualitatively. Tensile strength loss should, of course, be minimized. Accordingly, practice of this invention involves fluorination to the least reasonable extent, employing the most dilute fluorine (in a carrier gas), consistent with the level of reaction desired with never more than 20% preferably less than 10% fluorine content in the gas. A low fluorine content in the gas helps cool the reaction and facilitates preferential reactions desired for achieving uniform fluorination of fiber surfaces.

One realistic measurement for the fluorination reaction is, of course, the number of fluoride groups present on the fiber surface, with the meaningful value for fluorine content being the wt. (mg) of fluorine per $cm^2$ of fiber surface, preferably measured after washing the fluorinated fiber.

Measurement convenience will often dictate testing some weight of fiber or fabric then computing the carboxylate and fluoro groups present on the surface from fiber diameter, and density.

The fluoride content range for both polyester and nylon are the same; about $4\times10^{-7}$ to 4×10-1 $mgF/cm^2$, with preferred ranges of about $4\times10^{-6}$ to $1\times10^{-3}$ $mgF/cm^2$. However, it should be appreciated that actual practice of the invention always involves a particular treatment level, e.g. $1\times10^{-5}$ for a specific fiber material. The preferred treatment level will be different for each class of substrates, e.g. for nylon 6, nylon 6.6, polyethylene terephthalate etc., and usually takes into account fiber size, fabric weave count, etc. Treatment conditions are of course selected for the minimum treatment level consistent with the circumstances at hand. For example, if DACRON polyester filaments are being treated, a fluorination treatment to achieve $1\times10^{-5}$ mgF/cm$^2$ will be preferred. On the other hand, treatment of polyester fabric wound on a spool may well require fluorination treatment to $1\times10^{-3}$ mgF/cm$^2$ in order to be certain that the fabric had been fluorinated throughout. All the above fluoride content values provided are after wash values.

An additional measurement for the fluorination reaction is believed to be the number of carboxylate groups present on the fiber surface, a direct indication being the neutralization equivalent. The carboxylate content in milliequivalents per cm$^2$ would seem more definitive of the fluorination reaction product than wicking, since a wicking test is likely to depend on the fabric form, e.g. weave or knit; and the fiber, e.g. twist, monofilament, etc.

Unfortunately, accurate measurement of carboxyl content has proven difficult, and the neutralization values obtained may be unreliable. However, the increase in free carboxyl content relative to a comparable unfluorinated control is clear and substantial. Both polyamide and polyester fibers exhibit increases of up to 10 and even more times the carboxyl content present in the control. Since excessive fluorination may not create a corresponding increase in carboxylation levels (after wash), a 10 fold carboxyl content increase is believed to be a reasonable maximum increase for practice of this invention. In absolute numbers, a high degree of fluorination and carboxylation has increased samples of nylon 6.6 from $1.3\times10^{-5}$ meq/cm$^2$ to $15.9\times10^{-5}$ meq/cm$^2$, and a polyester sample from $2.9\times10^{-6}$ meq/cm$^2$ to $15.5\times10^{-6}$ meq/cm$^2$.

For treatment of bulk fabric, practice of this invention may involve fluorination after the fabric has been dyed. Fluorination has no adverse effect on most dyed polyamides and polyesters, and in the instance of bulk fabrics the almost inevitable minor degree of nonuniformity in fluorine content and wicking characteristics in the fabric will be immaterial to fabric appearance, use and strength.

DESCRIPTION OF PREFERRED EMBODIMENTS

In accordance with preferred practice of present invention, fluorinated carboxylated polyesters and polyamides are obtained by short cycle, direct fluorination in an atmosphere substantially free of oxygen, as described above. By short cycle is intended gas-solid reaction contact time of less than 15 minutes, preferably less than 5 minutes between fiber and fluorine. The resulting fluorinated carboxylated materials prepared by short cycle fluorination have increased water transport and soil release characteristics.

Brief reaction contact times, i.e. less than 15, preferably less than 5 minutes is desirable for polyamides, as for polyesters. Polyesters fluorinate readily, can be fluorinated satisfactorily in less than 1 minute. Polyamides are more sensitive than polyesters, require a more carefully controlled fluorination, normally involving a several minute treatment and a more careful cut and try adjustment for the equipment, fiber form and substrate resin.

In any event, all commercial polyesters and polyamide fiber form resins can be fluorinated-carboxylated in accordance with practice of the present invention.

In general, the polyesters have the repeating structure [-CORCO$_2$R$_1$-] where R is selected from the cyclic hydrocarbons $C_6H_{10}$ and linear hydrocarbons $C_nH_{2n}$, where n is an integer of 1 to 18, and $R_1$ is selected from the cyclic hydrocarbon radicals $C_6H_{10}O$ and $C_6H_4O$ and linear hydrocarbon radicals $C_nH_{2n}O$, where n is an integer of 1 to 18, and $(CH_2CH_2O)_b$, where b is an integer of 2 to 10. Such polyesters are prepared in the conventional manner by reaction of a carboxylic acid with an alcohol.

Among the polyester materials which can be used in accordance with the present invention are polymeric materials having the following repeating structures:

$\text{-}\!\!\!

tively, the material can be unrolled and rerolled inside the treatment chamber.

Instead of a continuous treatment such as described above, the treatment may be a batch operation in which the fiber form material is exposed to the fluorine carrier gas mixture in a reactor: the material being permitted to remain in contact with the gas mixture for a brief time interval.

Within the limits of the material (e.g. . . . melting point, etc.), the temperature and pressure at which the fiber form material is treated is not critical. However, the preferred temperature is room temperature, but higher temperatures, such as those ranging up to about 150° C or higher can be employed. Pressure inside the reaction vessel will ordinarily correspond to standard environmental pressures, although elevated pressures can be used without adverse effect.

As previously mentioned, direct fluorination of a polyester of polyamide material in an atmosphere substantially free of oxygen requires only a brief reaction time for a fluorinated carboxylated surface layer to form on the material. It has been found, according to the present invention, that exposure time for most types of polyester and polyamide resin fiber form materials generally requires less than five minutes. However, frequently less than one minute contact time is all that is needed in order to form a fluorinated carboxylated surface layer particularly on polyesters. It is well to keep in mind, however, the exposure period will vary with the concentration of fluorine in the gas mixture, in which case the time will be shortened when the concentration of fluorine is higher. Longer exposure times may be used, but in most instances are neither required nor considered desirable, especially from an economic viewpoint.

Again and again reference has been made to the desirability of limiting the oxygen content of the fluorinating gas to below about 1%. Water and water vapor are somewhat detrimental also and desirably should be avoided. In a preferred mode of this invention, the fabric should not be wet, i.e. should not exceed equilibrium with ambient moisture (less than about 0.5% $H_2O$ by wt. for polyesters, 4% for 6.6 nylon), and the fluorinating gas contain 0–1% oxygen and from 1–3% fluorine for polyesters, 1–5% for polyamides, the balance of the fluorinating gas may be inert e.g. nitrogen, and such is preferred. However, practice of this invention does contemplate fluorination in the presence of co-reactant gases. For example, fluorination and chlorination will both occur if chlorine is included in the carrier gas, even though chlorination by itself, would not occur without (light) activation. Accordingly, presence of other reactants in the carrier gas is not inconsistent with fluorination, and, indeed, most co-reactions will normally take place only as incident to the fluorination.

The significant process aspects for practice of this invention may be recapitulated as follows:

1. A reaction contact time between fiber form resin and reaction gases of less than about 15 minutes, less than 10 minutes being more desirable, and less than 5 minutes preferred.

2. A reaction gas composition having, by volume:

a. up to 20% elemental fluorine, less than 10% preferred, 0.1–5% being more desirable; specifically preferred is 1–3% for treatment of polyesters, 1–5% for treatment of polyamides.

b. limiting elemental oxygen content to below 5%, desirably to less than 1%, preferably less than 0.1%. To the extent possible a reaction gas substantially free of elemental oxygen is preferred.

c. balance of reaction gas preferably dry and inert.

When following the conditions noted above for fluorination according to practice of the present invention, it has been found the material will not char; there is little loss of other desirable characteristics of the material such as strength; low levels of fluorine are taken up by the fiber rather uniformly. Of course, the reaction vessel used in the fluorination process must be able to withstand the presence of fluorine and of hydrogen fluoride product of the reactions.

In the discussion of fluorination, exemplary values and preferred ranges have been provided. The values given for exemplary purposes are the fluorine content at the first realistic opportunity to measure same. Normal handling of the fiber form resin such as laundering will remove some but not all of the fluorine initially combined with the fiber form resin material. Except when indicated as pre-washing, the fluoride content values and the carboxyl values, too, are after a first washing of the material.

The fluorinated-carboxylated polyesters and polyamides prepared according to practice of this invention have a neutralization equivalent of about 25,000 or less, preferably less than 15,000. The neutralization equivalent (N.E.) is determined by dividing the weight (grams) of the acid times 1,000 by the milliliters of base times the normality of the base i.e. the "meq. of base."

$$\text{N.E.} = \frac{\text{wt. of Acid} \times 1{,}000}{\text{meq. of base}}$$

The neutralization equivalent is measured by an acid-base potentiometric titration performed in absolute methanol using a glass electrode as an indicator against a calomel reference electrode. The potential is measured on a pH meter (e.g. Beckman pH meter).

The carboxyl content of the fiber form resins may be determined in several ways. According to one procedure, the fluorinated material, e.g. a fabric, is first washed in dilute HCl, then thoroughly rinsed with distilled water, dried and weighed. Thereafter the material is immersed in a known amount of 0.0995 N methanolic sodium hydroxide, allowed to stand for 24 hours, then carefully rinsed with methanol to wash adhering base back into solution. The solution is then titrated with aqueous hydrochloric acid. The difference between the initial amount of NaOH and that measured represents the degree of acidity of the fabric.

An alternative procedure, interchangeable with the above, is the process of H. A. Pohl, Analytical Chemistry, Vol. 26, pg. 1614 (1954).

At low fluorination levels, the degree of carboxylation of polyester and polyamide will depend upon both reaction time and % $F_2$ is the reaction medium. At a given reaction time, carboxylation increases as % F incorporation increases. (Selecting specific fluorination process conditions for a particular fabric may require a cut and try approach within the already described reaction time and fluorine concentration ranges.) In this connection, the degree of carboxylation of polyester and polyamide are not believed to be related, since the cleavage rate for amide and ester linkages may differ. Thus nylon 6.6 treated to have between $4 \times 10^{-5}$ and $3 \times 10^{-3}$ mg F/cm$^2$, a preferred range will have a carboxyl content between $2 \times 10^{-5}$ and $15 \times 10^{-5}$ milliequivalents/cm$^2$ against a control measurement of $1.3 \times 10^{-5}$ meq/cm$^2$. A polyester (i.e. PET) control measured at $2.9 \times 10^{-6}$ meq/cm$^2$ and a highly carboxylated and fluorinated specimen contained $15.5 \times 10^{-6}$ meq/cm$^2$. Overall practice of this invention involves an increase in the free carboxyl content of the fiber form polyester or polyamide resin of at least 50%.

The following Examples illustrate embodiments of this invention. It is to be understood, however, that these are for illustrative purposes only and do not purport to be wholly definitive as to condition and scope for preferred practice of the invention.

Example I

A. A strip of 100% polyethyleneglycolterephthalate fabric having a dimension of 8 inches by 16 feet, weighing 230.5 grams, was draped in a 28 liter "Kynar" lined (polyvinylidene fluoride) reactor. The reaction vessel was then alternately evacuated and purged with nitrogen three times in order to eliminate as far as possible any residual oxygen. Subsequently, a gas mixture of 4% fluorine and 96% nitrogen from separate cylinders was blended before being charged into the reactor. The rate of flow from the fluorine cylinder was 0.6 liters/minute and 14.4 liters/minute from the nitrogen cylinder. The fluorine used was 99.7% pure with 0.3% impurities comprising about 90% nitrogen and about 10% of a mixture of oxygen, sulfur hexafluoride and carbon tetrafluoride. The nitrogen used was 100% pure. The fabric was exposed to the substantially oxygen free gas mixture for 5 minutes and the reactor was then evacuated and purged with nitrogen prior to removal of the sample. The sample was washed, dried and found to have 0.1% fluorine by weight.

The fluorine pickup was $8 \times 10^{-4}$ mg F/cm$^2$.

B. For purposes of comparing the rate of reaction (percent fluorine pickup) with the oxygen-free fluorination system of part (A) above, a strip of 100% Dacron fabric of similar dimension was treated in a similar manner. However, in this instance 10% oxygen was blended into the gaseous feed stream also along with 4% fluorine. The exposure time of the fabric to this gas mixture was also for 5 minutes.

After removal of the fabric from the reactor, it was washed, dried and found to have only about 0.018% fluorine by weight.

C. The same procedure of part (B) was followed once again, also using an untreated strip of 100% Dacron of known weight, exposed for 5 minutes to a 4% fluorine gas mixture. However, in this particular run 40% oxygen was mixed with the fluorine before being charged into the reactor. After a 5 minute exposure period the sample was washed, dried and found to have 0.01% by weight fluorine incorporated onto the fabric.

The percent fluorine impregnated onto the particular polyester material was determined in all instances using the Schoniger Combustion and Specific Ion Electrode Techniques according to the followng procedure:

Combust approximately 150 mg. sample in a Schoniger flask containing 25 ml. of 0.02 N sodium hydroxide. The solution containing the combustion products are then transferred to a 100 ml. volumetric flask. Ten ml. of standard TISAB solution (sodium nitrate, sodium citrate, acetic acid and sodium acetate mixture having a pH of 5.5) are added to the flask and diluted to volume. Standard fluoride solutions are prepared which encompass the expected levels of fluoride in the sample. The potential obtained with a specific fluoride ion electrode for the sample and standard solutions is recorded. Using a standard curve generated from the data for the standard fluoride solutions, the potential is recorded for the sample and the sample weight, and the fluoride percentage in the sample is then calculated.

EXAMPLES II - XIV

For purposes of determining the effect of longer exposure times on the rate of fluorination of polyester materials, further direct-fluorination batch runs were conducted using 100% Dacron fabric, employing both oxygen free gaseous mixtures and systems having both fluorine and oxygen present. Procedures in accordance with the methods of Example I, parts (A) - (C) were followed. Results are given in Table I below.

TABLE I

| Example | Gas Mixture | Treatment Time (minutes) | %F by wt. Incorporated | Neutralization Equivalent |
|---|---|---|---|---|
| II | 4% $F_2$/96% $N_2$ | 10 | 0.235 | 6,917 |
| III | " | 25 | 0.300 | 7,356 |
| IV | " | 40 | 0.455 | 7,654 |
| V | " | 65 | 0.515 | 5,576 |
| VI | 4% $F_2$/10% $O_2$/86% $N_2$ | 10 | 0.031 | — |
| VII | " | 30 | 0.065 | 11,523 |
| VIII | " | 60 | 0.095 | 10,527 |
| IX | " | 180 | 0.100 | 11,249 |
| X | " | 360 | 0.090 | 9,280 |
| XI | 4% $F_2$/40% $O_2$/56% $N_2$ | 10 | 0.019 | — |
| XII | " | 30 | 0.056 | 9,836 |
| XIII | " | 180 | 0.090 | 11,220 |
| XIV | " | 360 | 0.090 | 11,223 |

It may be concluded from Examples I - XIV that the percent fluorine incorporated onto the fabric per unit of time is significantly greater using a system substantially free of oxygen. This is aptly demonstrated inter alia by Example II which shows that after a 10 minute exposure to 4% fluorine and no oxygen, about eight (8) times more fluorine was taken up by the fabric than Example VI also havng 4% fluorine, but with 10% oxygen present. Furthermore, as the amount of oxygen was increased, according to Example XI (40% $O_2$) the take-up of fluorine by the polyester material diminished even further.

As a whole, Table I demonstrates that the presence of oxygen inhibits fluorination.

Example XV

The following short cycle procedure was employed in the continuous, direct-fluorination of polyester fabric:

A roll of polyester double knit fabric having the dimension of 12 inches × 50 feet was placed in a standard continuous treatment reactor having a volume of 708 liters. The system was then purged with nitrogen to eliminate all traces of oxygen. Purging continued for 12 hours at a flow rate sufficient to displace the volume of the reactor six times over.

A gas mixture comprising fluorine and nitrogen was introduced into the reactor at the rate of 3.5 liters/minute fluorine and 10.6 liters/minute nitrogen. The nitrogen used was 100% pure and the fluorine was 99.7% pure: the remaining 0.3% consisted of trace amounts of different fluorocompounds and oxygen. This gas mixture was permitted to flow for 20 minutes while the fabric passed slowly through the reactor chamber. This first exposure period was to provide for reactor equilibration.

Subsequently, the flow of gas was adjusted so that only 0.6 liters/minute fluorine and 1.8 liters/minute nitrogen entered into the reactor providing a mixture of 10% fluorine and 90% nitrogen. With this reduced flow of gas in operation the exposure time of the fabric was adjusted so that contact time of the fabric with the gas was only two (2) minutes.

After approximately 15 feet of fabric was treated at this two (2) minute exposure time the speed of the rewind roll was increased, so that the exposure time to the gas was adjusted to 30 seconds. An additional 15 feet of fabric was then treated.

Six samples taken at random from the exposed fabric were then washed in distilled water, dried and found to have taken up fluorine in the amount shown in the table below.

TABLE II

| Exposure Time | % Fluorine Incorporated |
|---|---|
| 30 Seconds | 0.41 |
| " | 0.39 |
| " | 0.39 |
| 2 minutes | 0.52 |
| " | 0.51 |
| " | 0.47 |

Samples of the 2 minute and 30 second exposed fabrics were tested for soil release properties. A drop of dyed mineral oil was applied to each of the two by one inch samples and on a control sample of untreated fabric. The samples were then submerged in a 0.1% solution of Ivory soap in deionized water. Each of the fluorinated-carboxylated samples released their oil stains within three (3) minutes whereas the control sample did not release the stain even after a 24 hour period.

It may be concluded from Example XV that fluorination of the substrate after 30 seconds of exposure was sufficient to impart the desired properties throughout the polyester fabric, and that protracted exposure time although offering greater fluorine pickup, nevertheless provided no perceptable advantages over the shorter exposure period.

EXAMPLE XVI

Samples for wicking data were secured from a 14 ft. strip 6.25 inches wide (Raschel knit) polyester wound on a 2 inch core. The wound roll (3.5 inches diameter) was fluorinated with 1% $F_2$/99% $N_2$. Samples (1 inch by 10 inches), taken from the outside, the inside and two intermediate intervals of the fabric, were submitted to wicking tests.

The wicking test procedure involves suspending a length of sample (e.g. 1 inch by 10 inches running with the grain of the fabric) above a beaker of (dyed) water. The bottom ¼ inch of sample is submerged in the water, at which time a stopwatch is activated. Readings should be taken periodically, i.e. 20 seconds, 1 minute, 3 minutes, 5 minutes; 5 minute intervals to determine (millimeter) rise of water versus time, measuring thereby moisture transport (of the dyed water).

The following table shows that relatively uniform wicking resulted.

TABLE III

| Time | Outside Edge (1 ft.) | Inside (5 ft.) | Inside (10 ft.) | Inside Edge (14 ft.) |
|---|---|---|---|---|
| 20 sec. | 17 mm. | 9 mm. | 29 mm. | 4 mm. |
| 1 min. | 31 | 20 | 50 | 56 |
| 3 | 60 | 36 | 78 | 90 |
| 5 | 84 | 42 | 89 | 111 |
| 10 | 128 | 69 | 115 | 142 |
| 15 | 149 | 87 | 135 | 160 |
| 20 | 163 | 109 | 146 | 174 |
| 25 | 174 | 127 | 154 | 180 |
| 30 | 179 | 135 | 157 | 182 |
| 35 | 182 | 143 | 157 | 183 |
| 40 | 184 | 147 | 157 | 183 |
| 45 | 184 | 147 | 157 | 183 |

EXAMPLE XVII

A multiplicity of tests were conducted on 100% PET (DACRON) using the following test procedures:

Polyester fabric was scoured, triple rinsed and tumble dried prior to fluorination. An 8 inch × 10 inch sample was then suspended in a 2 liter monel reactor. For static reactions the reactor was evacuated and purged with nitrogen four (4) times. After the fifth evacuation the reactor was brought to atmospheric pressure by filling with the fluorine/nitrogen/oxygen (if any) mixture. The fill time was 30 seconds and reaction contact time was 2 minutes. Flow reactions were run by evacuating the reactor, purging with nitrogen, evacuating and applying a flow of $F_2/N_2$ for 2 minutes.

At the end of the two minute reaction time, the fabric was removed from the reactor and washed by standard AATCC wash procedure. After tumble drying, the fabrics were ready for wicking and tensile strength tests.

The test results were as follows:

A. TENSILE STRENGTH LOSS

| % F | Tensile Strength lbs. Flow | Static | Static 1% $O_2$ |
|---|---|---|---|
| Control | 87.5 | 87.5 | 87.5 |
| 0.5 | 90 | 87 | 86 |
| 1 | 82 | 84 | 75 |
| 3 | 82 | 82 | 68 |
| 5 | 82 | 75 | 75 |
| 7 | 26 | 70 | 75 |
| 10 | Burned | 67 | 46 |

The results indicate that a flow reaction decreases tensile strength faster than a static reaction, and that addition of 1% oxygen lowers tensile strength.

| B. WICKING PROPERTIES | Wicking Height mm. | | |
|---|---|---|---|
| % F | Flow | Static | Static 1% $O_2$ |
| Control | 10 | 10 | 10 |
| 0.5 | — | 77 | 88 |
| 1 | 70 | 103 | 89 |
| 3 | 61 | 109 | 90 |
| 5 | 53 | 103 | 92 |
| 7 | 27 | 105 | 47 |
| 10 | Burned | 90 | 32 |

The test results indicate that a flow reaction gives a product having poorer wicking properties than a static method, and that presence of oxygen decreases wicking properties.

The effect of oxygen content on tensile strength and wicking in a static test, 1% $F_2$, is shown by the following table.

| C. EFFECT OF OXYGEN | Tensile Strength and Wicking | |
|---|---|---|
| % $O_2$ | Tensile lbs. | Wicking, mm. |
| Control | 87.5 | 10 |
| 0.5 | 85 | 95 |
| 1.0 | 75 | 93 |
| 3 | 74 | 93 |
| 5 | 73 | 81 |
| 8 | 70 | 86 |
| 10 | 69 | 84 |
| 20 | 69 | 85 |

The test results indicate that increasing oxygen concentration brings about decreased tensile strength and wicking properties.

D. The observed carboxyl content was determined for the control and a highly fluorinated carboxylated specimen.

Control - $2.91 \times 10^{-6}$ meq/cm$^2$ ($1.75 \times 10^{15}$COOH/cm$^2$) Fluorinated - $15.5 \times 10^{-6}$ meq/cm$^2$ ($9.33 \times 10^{15}$COOH/cm$^2$)

EXAMPLE XVII

Nylon 6.6 (Testfabrics Style 358) was placed in a monel reactor and then evacuated and purged with nitrogen four (4) times to remove any oxygen present in the reactor. Various mixtures of fluorine/nitrogen were admitted to the reactor at varying (static) reaction times. Table 17-1 gives several examples of the fluorine concentrations and reaction times used. It can be seen from Table 17-1 that high fluorine concentrations or long reaction times increase the percent fluorine incorporated.

TABLE 17-1

| Sample | % $F_2$/$N_2$ | Reac. Tm. (Min) | % F Incorp. | meq/cm$^2$ $\times 10^{-5}$ |
|---|---|---|---|---|
| 1833-12-1 | 4/96 | 3 | 0.17 | 4.27 |
| 1833-12-2 | 4/96 | 6 | 0.16 | 3.70 |
| 1833-12-3 | 4/96 | 11 | 0.14 | 3.58 |
| 1833-12-4 | 4/96 | 25 | 0.44 | — |
| 1833-14-1 | 8/92 | 3 | 1.32 | 6.80 |
| 1833-14-2 | 8/92 | 6 | 2.13 | 7.84 |
| 1833-14-3 | 8/92 | 11 | 3.45 | 15.89 |
| 1833-14-4 | 8/92 | 25 | 6.43 | — |
| 1833-15 | 10/90 | 3 | 2.59 | 8.23 |
| 1833-17-1 | 4/96 | 1 | 0.31 | 2.54 |
| 1833-17-2 | 8/92 | 1 | 1.57 | 3.78 |
| 1833-17-3 | 10/90 | 1 | 2.63 | 6.37 |
| Control | | | | 1.31 |

Nylon that was fluorinated at low fluorine concentrations or short reaction times showed less loss of tensile strength than high fluorine concentrations or long reaction times. The nylon increases in acidity with longer reaction times and with increasing fluorine concentration in the reaction.

Nylon that was fluorinated at low fluorine concentrations or short reaction times showed better wetting (AATC test method 39-1971) than the control (Table 17-2). Fluorinations at high fluorine concentrations or long reaction times reduces the wettability versus short reaction times or low fluorine concentrations.

TABLE 17-2

| Sample | %$F_2$/$N_2$ | Reaction Times (min) | Wetting Time (sec) |
|---|---|---|---|
| Control | | | 11,911 |
| 1833-12-1 | 4/96 | 3 | 117 |
| 1833-12-2 | 4/96 | 6 | 92.5 |
| 1833-12-3 | 4/96 | 11 | 128.7 |
| 1833-12-4 | 4/96 | 25 | 636 |
| 1833-14-1 | 8/92 | 3 | 193 |
| 1833-14-2 | 8/92 | 6 | 8,802 |
| 1833-14-3 | 8/92 | 11 | — |
| 1833-17-1 | 4/96 | 1 | 231 |

Nylon that was fluorinated at low fluorine concentrations or short reaction times showed better water transport (wicking) than the control. The material was cut into one inch strips and the ends immersed in an aqueous dye solution. The rate of climb of liquid was then measured. Table 17-3 provides the wicking height results for the different F concentrations and reaction times.

TABLE 17-3

| Wicking Time Minutes | Wicking Heights 4% $F_2$ 1 min. | 3 min. | 25 min. | 8% $F_2$ 3 min. | 8 min. |
|---|---|---|---|---|---|
| 2 | 12 | 40 | | | |
| 3 | | | | 15 | 12 |
| 10 | 74 | 86 | 19 | 42 | 25 |
| 15 | 94 | | | | |
| 17 | | 106 | 32 | | |
| 25 | 121 | | | 70 | 40 |
| 26 | | 116 | | | |
| 34 | | | | | |
| 35 | 130 | | 51 | | |
| 36 | | 124 | | | |
| 37 | | | | 82 | 47 |
| 45 | | | | 85 | 52 |
| 50 | 140 | 132 | 57 | 87 | 57 |

EXAMPLE XVIII

Nylon that was fluorinated in the presence of small oxygen concentrations showed a decrease in the % F incorporated; thus, oxygen inhibits the rate of fluorine incorporation (Table 18-1).

TABLE 18-1

| Sample | % $F_2$/$O_2$/$N_2$ | Reaction Time (min) | % F Incorp. | Tensile Strength (lbs) |
|---|---|---|---|---|
| Control | | | | 59 |
| 1824-29 | 4/-/96 | 6 | 1.74 | 56 |
| 1833-34-1 | 4/1/95 | 6 | 0.69 | 43 |
| 1833-34-2 | 4/2/94 | 6 | 0.41 | 45 |
| 1833-34-3 | 4/3/93 | 6 | 0.42 | 39 |
| 1833-34-4 | 4/5/91 | 6 | 0.31 | 41 |
| 1833-44-2 | 4/1/95 | 3 | 0.75 | — |
| 1833-44-3 | 4/5/95 | 3 | 0.54 | — |

Nylon that was fluorinated in the presence of small oxygen concentrations showed greater tensile strength loss than when oxygen was excluded from the reaction media. All the reactions were run for six minutes.

While the invention has been described in conjunction with specific examples thereof, they are illustrative only. Accordingly, many alternatives, modifications and variations will be apparent to those skilled in the art in light of the foregoing description, and it is therefore intended to embrace all such alternatives, modifications, and variations as to fall within the spirit and broad scope of the appended claims.

We claim:

1. An oil stain release moisture transporting fiber form comprising a synthetic resin selected from the group consisting of polyamides and polyesters, said fiber form being surface fluorinated from about [$4 \times 10^{-7}$ to $4 \times 10^{-1}$] $4 \times 10^{-6}$ to $1 \times 10^{-3}$ mg F/cm$^2$ on an after wash basis, said fluorinated fiber form exhibiting a neutralization equivalent of below about 15,000 and said fluorinated fiber form having at least 90% of the tensile strength of untreated fiber form.

2. The fluorinated fiber form of claim 1 wherein the carboxy content thereof is at least 50% more than the carboxyl content of untreated fiber form.

3. The fluorinated fiber form of claim 1 wherein the resin is a polyamide.

4. The fluorinated fiber form of claim 1 wherein the resin is a polyester.

5. The fluorinated fiber form of claim 1 wherein the fiber form is fabric.

6. A method for surface treating a fiber form comprising a synthetic resin selected from the group consisting of polyamides and polyesters which comprises contacting the fiber form for less than 15 minutes with a fluorine containing gas having less than about 1% by volume of elemental oxygen, and from about 0.1-5% by volume of elemental fluorine to a combined fluorine level in the fiber form to from $4 \times 10^{-6}$ to $1 \times 10^{-3}$ mg F/cm$^2$ on an after wash basis.

7. The method of claim 6 wherein the fluorine containing gas has less than about 0.1% by volume of oxygen.

8. The method of claim 6 wherein the fluorine containing gas is substantially free of oxygen.

9. The method of claim 6 wherein the fiber form treated is a fabric.

10. The method of claim 6 wherein the fiber form fluorinated is an already dyed fabric.

11. The method of claim 6 wherein the fluorination gas fiber form contact time is less than about 10 minutes.

12. The method of claim 6 wherein the fluorination gas fiber form contact time is less than about 5 minutes.

13. The method of claim 6 wherein the fiber form resin is a polyamide.

14. The method of claim 6 wherein the fiber form resin is a polyester.

* * * * *